US012428826B1

(12) United States Patent
Hunt

(10) Patent No.: US 12,428,826 B1
(45) Date of Patent: Sep. 30, 2025

(54) KITCHEN SINK CORRALLING AND TRANSFER APPARATUS

(71) Applicant: James Michael Hunt, Winchester, MA (US)

(72) Inventor: James Michael Hunt, Winchester, MA (US)

( * ) Notice: Subject to any disclaimer, the term of this patent is extended or adjusted under 35 U.S.C. 154(b) by 243 days.

(21) Appl. No.: 18/222,457

(22) Filed: Jul. 16, 2023

Related U.S. Application Data

(63) Continuation-in-part of application No. 17/702,395, filed on Mar. 23, 2022, now abandoned.

(51) Int. Cl.
*E03C 1/264* (2006.01)

(52) U.S. Cl.
CPC ..... *E03C 1/264* (2013.01)

(58) Field of Classification Search
CPC ..... E03C 1/26; E03C 1/264
USPC ..... 4/295, 292; 15/105
See application file for complete search history.

(56) References Cited

U.S. PATENT DOCUMENTS 1,115,016 A * 10/1914 Pheils ..... B65F 1/1447 193/11
2,761,626 A * 9/1956 Gustaveson ..... E03C 1/2665 241/46.016
4,519,102 A * 5/1985 Efstratis ..... E03C 1/26 241/46.016
5,271,108 A * 12/1993 Wicke ..... E03C 1/26 4/292

* cited by examiner

*Primary Examiner* — Christine J Skubinna

(57) ABSTRACT

The present invention relates to an apparatus for facilitating the corralling of food debris solids and liquids within the in sink space, and prevents dish ware from crowding the sink drain for enabling such debris to be deposited immediately to the garbage disposal. This is due to the fact that the apparatus creates a physical barrier by having a vertical structure height, which overcomes the height of multiple levels of dish ware to be held back from the sink drain hole preventing glass ware to tip over when jammed together in a sink thereby preventing its breakage.

10 Claims, 9 Drawing Sheets

KITCHEN SINK CORRALLING AND TRANSFER APPARATUS

REFERENCE TO RELATED APPLICATION

This is a continuation-in-part of my prior application Ser. No. 17/702,395 filed Mar. 23, 2022 currently in a pending status.

FIELD OF THE INVENTION

This invention relates to a food debris transfer apparatus and refers more particularly to an apparatus to facilitate the corralling and transferring of food solids and liquids being sent to a garbage disposal from the kitchen in sink space where a garbage disposal is attached to the underside of the kitchen sink.

BACKGROUND OF THE INVENTION

In the operation of washing dishes in a sink, moreover a kitchen sink, where food debris is present and must be discarded; access to the garbage disposal becomes encumbered. Dishes cover the sink drain hole and access is blocked.

U.S. Pat. No. 7,150,576B1 A clog free drain for a surface water drain such as that utilized in a tub or stall shower including a basket having side openings permitting waste water to flow there through and into the drain pipe in which the basket is disposed. Directing waste water into the basket is by a sleeve located coaxially of the basket and the drain pipe and below the drain plate whereby the waste water flows through the sleeve, out an opening in the bottom thereof in to the closed bottom of the basket. The waste water accumulates below and into the sleeve and into the basket to a level of the side openings in the basket where it flows into the drain pipe. Pooling of the waste water in the bottom of the basket allows the debris, hair, soap scum and other suspended particles to accumulate in the bottom of the basket and thus separated from the waste water flowing in to the drain pipe.

U.S. Pat. No. 10,570,595B2 A removable strainer basket, a drain assembly incorporating the basket and a method of using the same. The drain assembly includes a flange assembly mounted in an aperture in a bottom wall of the receptacle. The flange assembly defines a bore therein and a stopper is engaged with the flange assembly and is selectively movable between open and closed positions. A strainer basket is removably positionable within the bore between a part of the stopper and a part of the flange assembly. The strainer basket defines a plurality of apertures therein and through which water is able to flow when the stopper is in the open position. The strainer basket captures hair strands and other articles entrained in the draining water. The basket is selectively removable from the flange assembly for cleaning.

U.S. Pat. No. 3,813,708A A drain bowl, fastened within the drain opening of a kitchen sink, is provided with a keyhole slot type opening through its bottom, with a wedge shaped cam formed around the opening on the bottom surface of the drain bowl. A bowl-shaped strainer is nested within the drain bowl and has an integral central stem extending downwardly through the hole with a radial projection engaged with the cam beneath the drain bowl bottom to seal the strainer downwardly against the drain bowl interior wall. A coil spring surrounding the stem and engaged between the bottom of the strainer and the interior surface of the bottom of the drain bowl, forces the strainer upwardly for spacing the strainer from the drain bowl, for drainage there between, when the strainer is rotated to disengage the projection from the cam.

SUMMARY OF THE INVENTION

An aspect of the invention is to provide an apparatus for facilitating the corralling of food debris solids and liquids within the in sink space, but not limited to such debris, be delivered directly into the garbage disposal unencumbered.

Another aspect of the invention is to provide an apparatus which physically prevents dish ware from crowding the sink drain for enabling such debris to be deposited immediately to the garbage disposal.

A still further aspect of the invention is to provide a conical frustum area for corralling and transferring large sized food debris solids, chunky yogurt liquids or the like within the in-sink space.

In a still further aspect of the invention, the apparatus, when installed in its useful position, will not interfere with the flow of water from the outside of the apparatus through to the garbage disposal.

A further aspect of the invention is to provide an apparatus for creating a physical barrier by having a vertical structural height thereby overcoming the height of multiple levels of dish ware to be held back from the sink drain hole, additionally, not short enough to enable cups and glassware to tip over when jammed together in a sink causing breakage as a garbage disposal guard would do.

Another aspect of the invention is to provide an apparatus which enables water, seeds and the like to be transferred into the sink drain hole through tear drop weep holes of the apparatus.

A further aspect of the invention is to provide an apparatus which prevents splashing back of liquids and solids from the sink, and also splashing back of liquids into the sink. This is accomplished by providing top flap covering over the tear drop weep holes. The flaps diverts the liquids being poured into the apparatus from the in-sink orifice effectively shielding the tear drop weep holes from all liquids and solid debris being corralled and transferred through the proposed apparatus.

Another aspect of the invention is to provide an apparatus which enables easy removal from and insertion into the in sink space of the kitchen sink by providing a pair of hand holds.

DETAILED DESCRIPTION OF THE PRESENT INVENTION

Embodiments described and claimed herein address the foregoing problem by providing a kitchen sink debris corralling and transfer apparatus. The sink debris corralling and transfer apparatus may be made of a flexible, semi-flexible or solid material or combination of different materials to achieve the same fit and/or function.

The term "in-sink" is used to denote the three-dimensional sink environment above the top of the sink flange horizontal plane where dishes are laid therein to be washed and is the location of the proposed invention apparatus "in-sink orifice" when installed in its useful position. The term "sink flange orifice" is used to denote the proposed invention apparatus orifice that resides below the top of the sink flange horizontal plane and is in the sink flange environment in its useful position and may create a connection with the sink flange vertical wall. The apparatus has an inverted conical frustum shape with a singular inward angle as measured from the apparatus inner wall in-sink orifice.

The material used for the said apparatus may include any one of silicone, TPU, stainless steel or a combination of all.

The walls of the apparatus are solid and may be made of uniform thickness through the full body cavity. The interior is open and unobstructed from top to bottom except for the tear drop weep holes. The apparatus orifice's geometric shapes are circular in the preferred embodiment but may be comprised of other geometric shapes while staying within the scope of fit and/or function.

Figure 1:
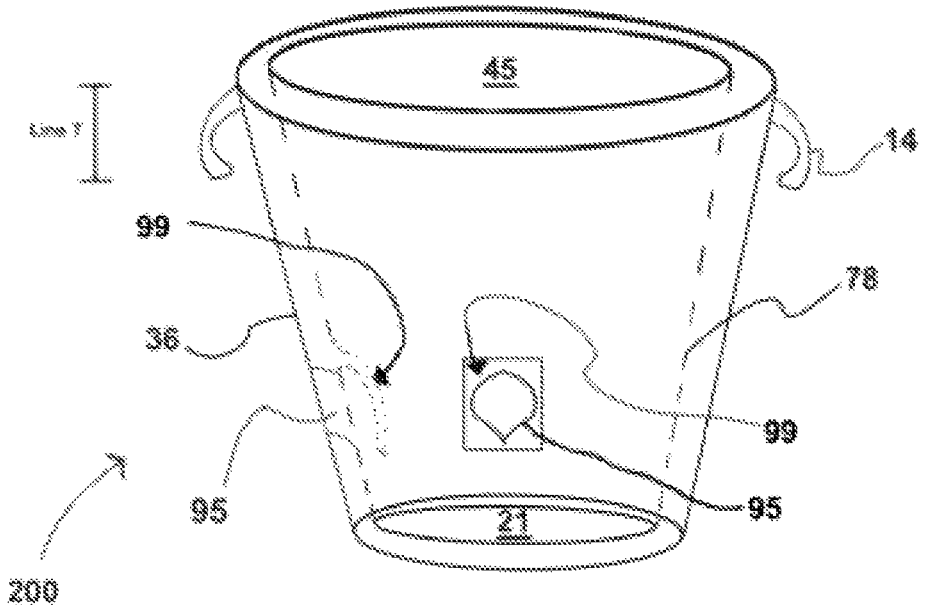
FIG. 1 illustrates a side perspective view of an exemplary embodiment of the kitchen sink debris corralling and transfer apparatus of the present invention.

Referring to FIG. 1, the present apparatus has an inverted conical frustum area for corralling and transferring large sized food debris solids, chunky yogurt liquids or the like within the in-sink space, where strainers and stoppers do not serve such purpose and is not located primarily within the in-sink space unlike the proposed apparatus is, when installed in its useful position.

Another aspect of the present apparatus is, in its useful position, when installed, it does not interfere with the flow of water from the outside of the apparatus through to the garbage disposal.

FIG. 1 further illustrates a side perspective view of an exemplary embodiment of the sink debris corralling and transfer apparatus invention 200. The apparatus 200 has a particularly inverted conical frustum shape comprising an in-sink orifice 45 that in vertical arrangement is the orifice residing in the in sink space environment. Another orifice of the smaller diameter than the said in-sink orifice, is the sink flange orifice 21 residing below the top of the sink floor's horizontal plane. Both the in-sink orifice 45 and the sink flange orifice 21 are arranged such that both orifice centers are vertically centered over each other. The in-sink orifice 45 and the sink flange orifice 21 are joined by an angular wall 78, thereby forming the shape of inverted conical frustum shape.

The thickness of the wall may be increased by providing an outer wall 36 concentric with the inner wall 78, thereby providing stability to the apparatus.

In some embodiments, the inner wall 78 may be fused with the outer wall 36 to form a singular thickness wall. In other embodiments the walls may be singular.

The apparatus when placed in the "in-sink" space in useful position of the sink, the said in-sink orifice 45 having the larger diameter resides in the mentioned "in-sink space" whereas the sink flange orifice 21 is located below the sink floor or the horizontal plane of the sink floor 74 and is in the sink flange 58.

The apparatus 200 further comprises tear drop weep hole(s) 95, which, as the name suggests, is shaped like a water/tear drop. The tear drop weep hole enables seeds including both larger type of seeds such as, but not limited to watermelon seeds or the like and smaller solids and liquids to pass through the apparatus 200 and into the sink drain hole 53. The tear drop weep hole 95 is located near the bottom of the apparatus 200 and more specifically in proximity to the sink flange orifice 21. More specifically, the wider part of the tear drop weep hole 95 is located above the top of the sink flange and sink floor union horizontal plane and the tapered portion of the tear drop weep hole 95 intersects the said plane and terminates below the top of the sink floor and sink flange union horizontal plane. The tear drop weep hole 95 location and size will be described more in detail in FIG. 11.

The tear drop weep holes 95 may be of any material(s) or number(s) or repeating pattern along the sink floor horizontal plane to achieve the same fit and/or function.

Figure 2:
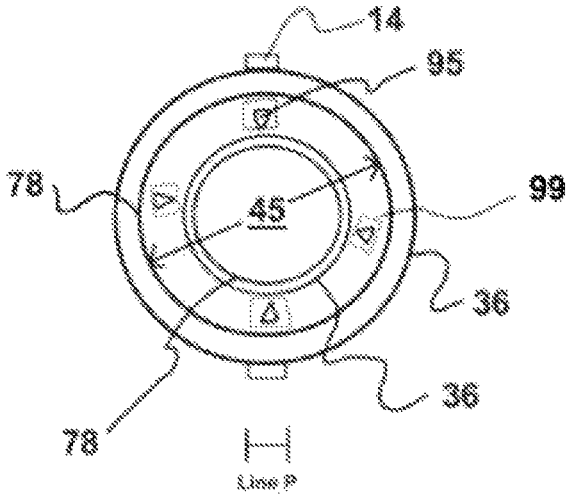
FIG. 2 illustrates a top view of an exemplary embodiment of the kitchen sink debris corralling and transfer apparatus of the present invention.
Figure 3:
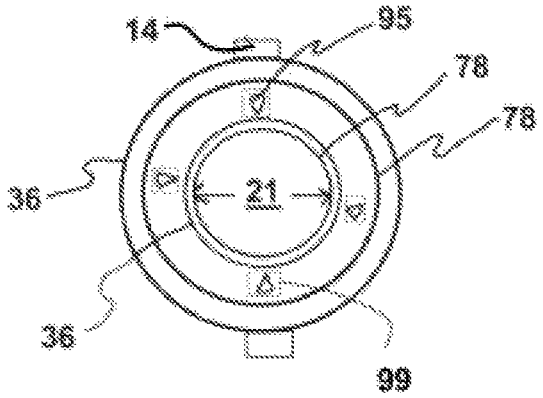
FIG. 3 illustrates a bottom view of an exemplary embodiment of the kitchen sink debris corralling and transfer apparatus of the present invention.

In some embodiments of the present invention and referring to FIG. 1-3, a flap 99 is provided above each tear drop weep hole 95. When the apparatus is in a useful position vertically, the flap 99 is attached to the inner wall 78 above each tear drop weep hole 95 and covers minimally the width of the weep hole 95 in a horizontal plane and minimally the height of the weep hole in a vertical plane.

The flap 99 may be of, but not limited to, an inward semi-circular or arcing shape, from the angular inner wall 78, or be of a solid inward arcing annular ring with a singular angle inward from the inward angle of the apparatus inner wall 78 encompassing all the tear drop weep hole 95 in entirety.

The embodiment of flap 99 is an improvement over the previous version of the apparatus in that the flap 99 embodiment diverts solids and poured liquids into the in-sink orifice 21 into and through the apparatus without spillage back into the sink through the tear drop weep holes 95. The flap 99 further allows the solids and liquids to pass over the tear drop weep holes 95 by covering the said tear drop weep hole 95 there by diverting the solids and liquids over the tear drop weep holes 95 and into the garbage disposal.

Another embodiment, depicted in FIG. 1, are a pair of handholds 14 positioned near the circumference of the top orifice of the in the sink debris corralling and transfer apparatus 200 which assists in installation or removal of the apparatus from the in-sink space. To enable assisting the apparatus's removal and insertion, a minimum size of the finger hold having a height of ⅜ of an inch is required and is represented by Line T.

FIG. 2 and FIG. 3 illustrate a top and bottom view respectively of an exemplary embodiment of the sink debris corralling and transfer apparatus 200. FIG. 2 illustrates the minimum width required of the handhold as represented by Line P which is no less than ¼th of an inch wide. Any width smaller does not allow the user to have an effective hold on the apparatus when a vertical pressure is needed to either remove or insert the apparatus.

This view further shows the annular plurality of tear drop weep holes 95 spaced evenly around the apparatus 200. The number of tear drop weep holes 95 may be singular or in a plurality count along a horizontal annular plane when the apparatus is in the useful vertical position. The tear drop weep holes 95 may or may not be evenly spaced. The tear drop weep holes 95 may take on various spacing. These illustrations also show the inner wall 78 and the outer wall 36 and the flap 99 covering the tear drop weep hole(s) 95.

Figure 4:
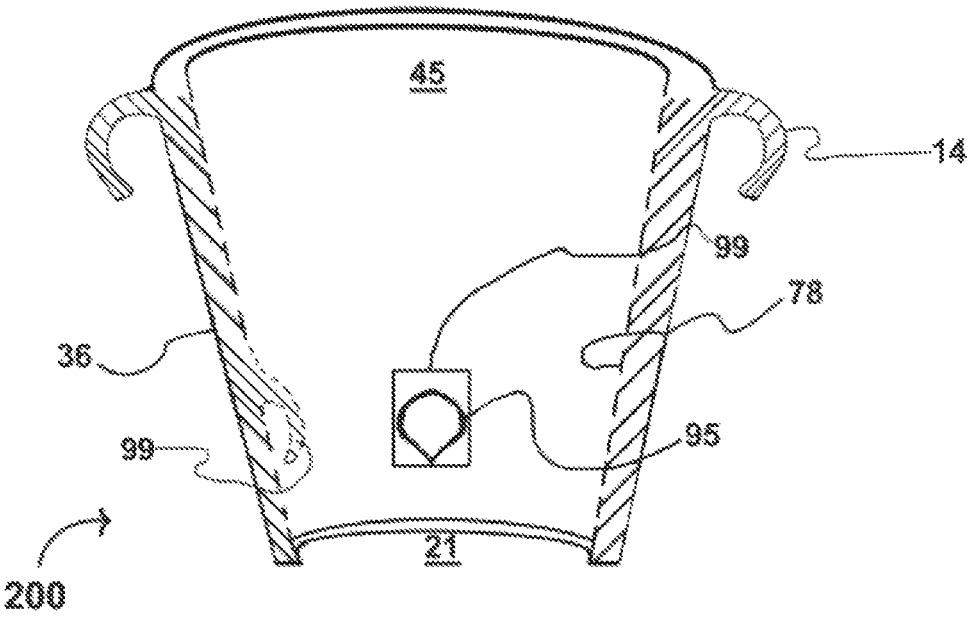
FIG. 4 illustrates a side section view of an exemplary embodiment the kitchen sink debris corralling and transfer apparatus of the present invention.

FIG. 4 illustrates a cross section view of an exemplary embodiment of the sink debris corralling and transfer apparatus 200. As denoted by the hash marks, the inner wall 78 and outer wall 36 are fused to create a singular wall. It is possible to view the angle of the inner wall 78 as the center of both the in-sink orifice 45 and sink flange orifice 21 are aligned. This angled inner wall 78 is instrumental the functioning of the apparatus 200 and is shown in detail in FIG. 8. The angled inner wall 78 allows for a larger sized in-sink orifice 45 allowing for a greater food and liquid capture area in relation to the smaller sink flange orifice 21. The angled wall also allows the food to be captured in volume into the said apparatus 200 and focuses debris under gravitational force downward and inward, thus accelerating solids and liquids through the sink flange orifice 21. The tear drop weep holes 95 are also located proximal to the sink flange orifice 21.

Figure 5:
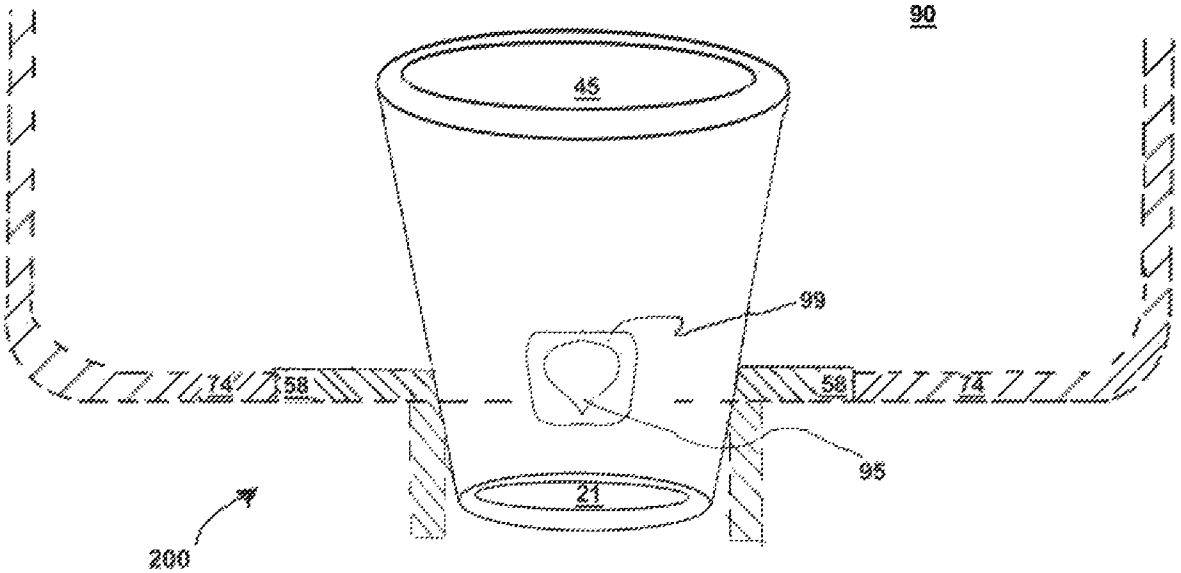
FIG. 5 illustrates the sink debris corralling and transfer apparatus in a kitchen sink environment of the present invention.

FIG. 5 illustrates the sink debris corralling and transfer apparatus 200 in an environment which is the "in-sink" area 90. The illustration further shows the apparatus 200 in a useful position. The position of use also employs a physical union made between said apparatus singular angled outer wall 36 and the vertical wall of a sink flange 58. The physical union may be comprised of a sealing connection, either water or non-water tight.

The apparatus 200 has tear drop weep holes 95 that are located, in a vertical arrangement, proximal to the sink flange orifice 21. The tear drop weep holes 95 are positioned on the wall of the apparatus 200 wherein the widest portion of the tear drop weep hole 99 is above the sink floor 74 horizontal plane allowing seeds, small solids and liquids to drain from the sink floor 74 through the widest portion of the tear drop weep holes 95 and into the garbage disposal. The sink drain hole 53 is shown with a typical drain flange 58 that the apparatus 200 would make the physical connection thereto. Also shown is the flap 99 embodiment surrounding the tear drop weep hole 95.

The illustration also shows how the apparatus in a useful position has a length from the top of the sink floor 74 horizontal plane to the in-sink orifice 45 being much greater than that of the length of apparatus below the said sink floor 45 horizontal plane to the sink flange orifice 21 in the useful position as shown. To define the apparatus usefulness in the sink environment, it is important to give the ratio of these lengths. More specific ratios of these lengths will be specified in FIG. 9.

Figure 6A:
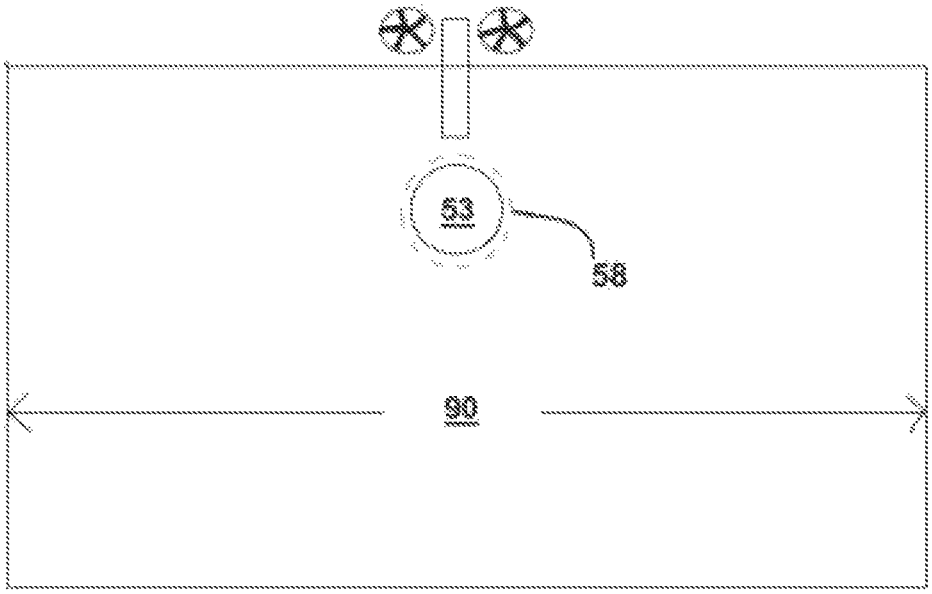
FIGS. 6*a* and 6*b* illustrates the "in-sink" physical space that the kitchen sink corralling and transfer apparatus would reside therein of the present invention.
Figure 6B:
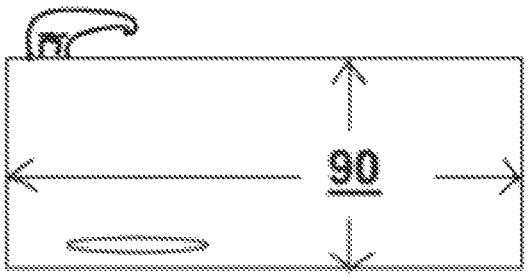

FIG. 6*a* illustrates the plan view of the "in-sink" physical space 90 that the sink corralling and transfer apparatus would reside therein and FIG. 6*b* illustrates the front view of the apparatus. The apparatus 200 physical capacity to contain in-sink debris is predominately located in the "in-sink" physical space 90 in all planes of physical space, x, y and z, denoting width, height and length, respectively.

The distal portion of said apparatus 200 in a vertical arrangement physically resides within an attachment to the sink drain hole 53 and comprises of a physical connection or union to a typical sink flange 58 or sink floor 74. This attachment to the sink drain hole's 53 circumference may be in the form of a sink flange 58, garbage disposal flange, or any connection to the sink drain hole 53 and is made of metal or any other material.

In a vertical arrangement the distal portion of the apparatus's outer wall 36 exemplary embodiment may physically unite with the vertical wall of a sink flange 58, or the like, that covers the sink drain hole 53. This flange 58 could also be a part of a garbage disposal flange or any other type of flange that covers a sink hole drain 53. There may also be instances where the sink itself doesn't use an additional flange but is incorporated into said sink in which case the apparatus 200 performs the same function.

Figure 7:
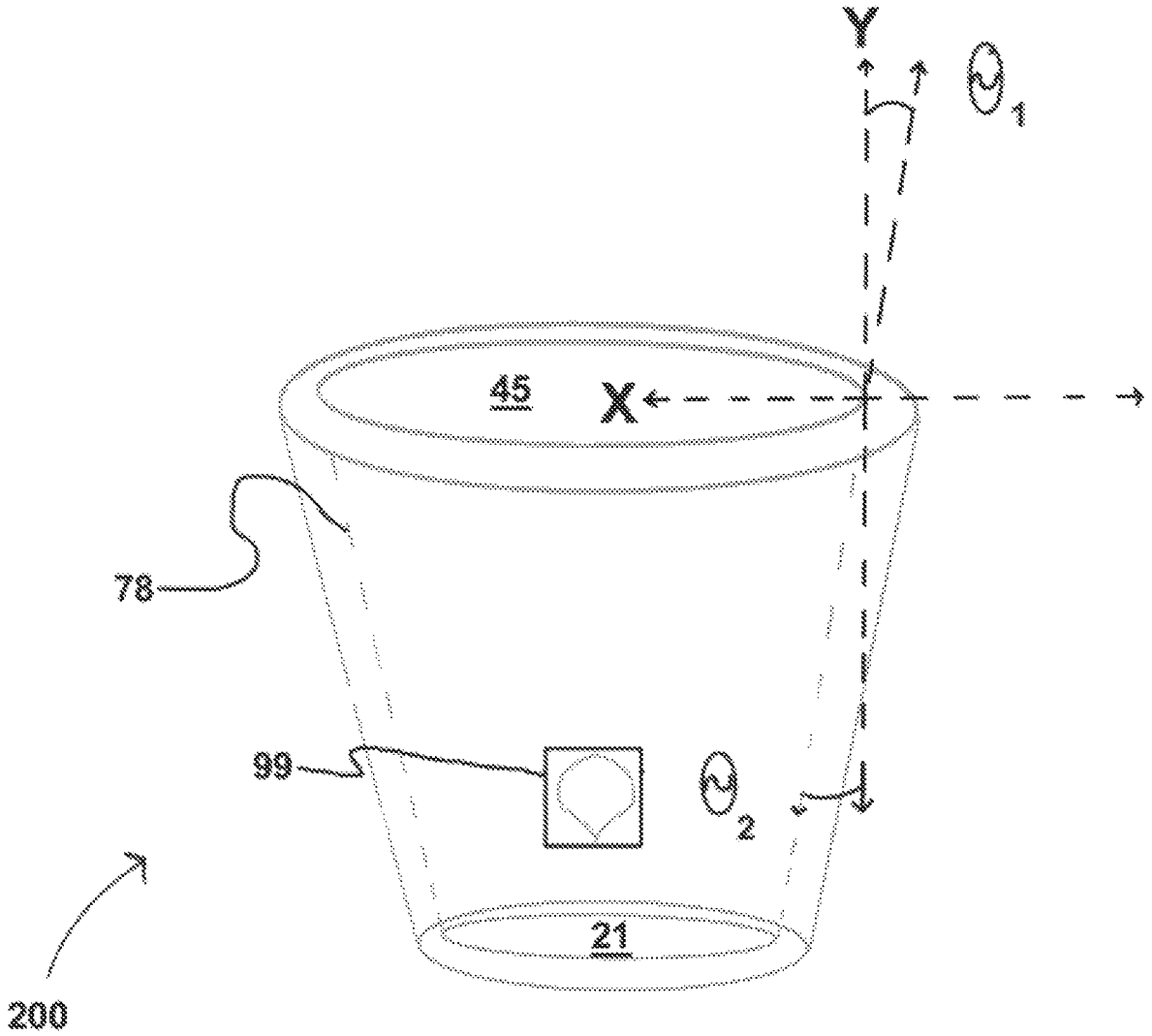
FIG. 7 illustrates the kitchen sink debris corralling and transfer apparatus singular angle of inner wall of the present invention.

FIG. 7 illustrates the sink debris corralling and transfer apparatus angle of inner wall 78. In this illustration the sink debris corralling and transfer apparatus 200 is in a non-opaque color and the inner wall 78 is represented as having a non-opaque hashed line denoting the said inner wall 78.

The black color hashed line is representative of the X axis and Y axis. The angled black hash line is the angle of the original inner wall 78 that connects both in-sink orifice 45 and smaller sink flange orifice 21 as their centers are vertical aligned with each other. Also of note here is that there are two symbols. These symbols are the Greek letter theta representing an angle. The said apparatus 200 has an angle theta 1 equal to an angle theta 2. Mathematically, these two opposite angles are equal, denoting that the inner wall 78 takes on an inward angle as measured downward from the top of the inner in-sink orifice. Theta 1 or theta 2 may not be equal to zero degrees from the Y axis for the full or partial length when measured vertically from top to bottom.

Figure 8:
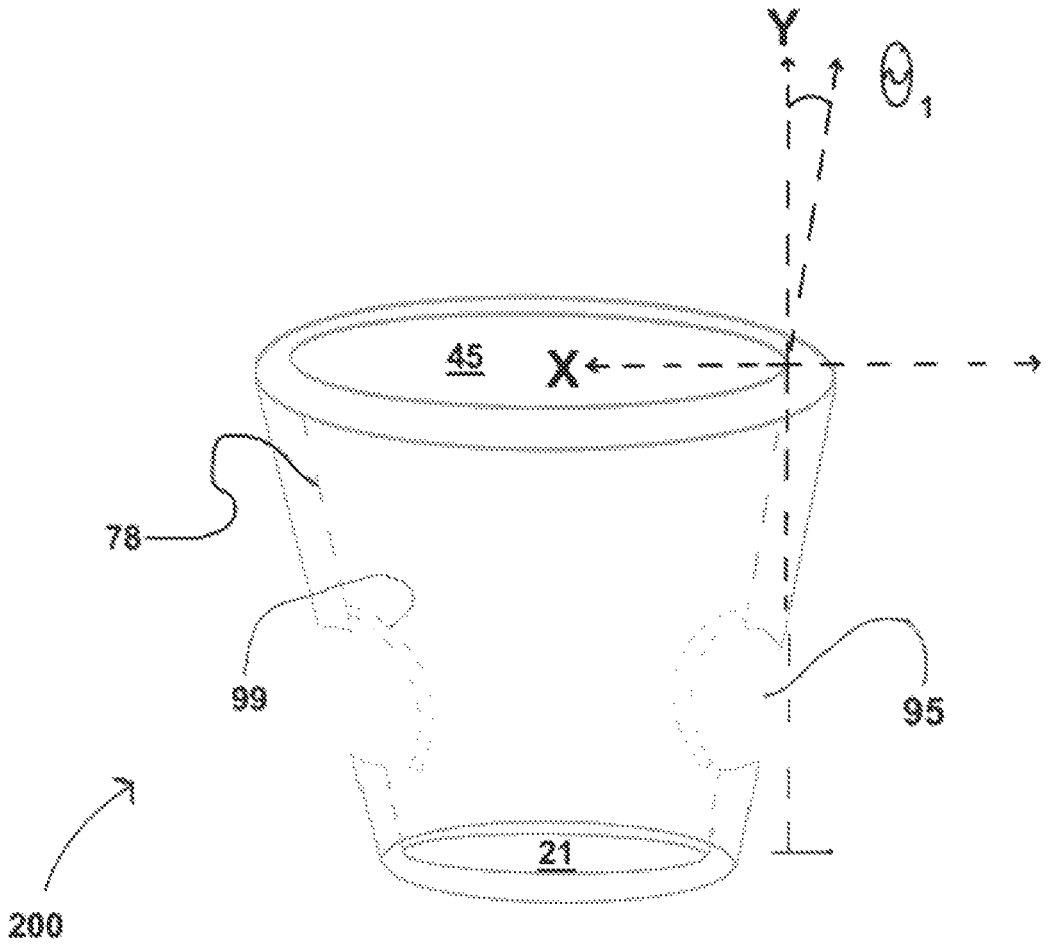
FIG. 8 illustrates the kitchen sink debris corralling and transfer apparatus emphasizing the flap embodiment location around the tear drop weep hole embodiment from a side perspective of the present invention.

FIG. 8 illustrates an embodiment of the sink debris corralling and transfer apparatus's flap 99 encompassing the tear drop weep hole 95 of the present invention which is an internal inward arching extension of the inner wall 78 of the present apparatus. The cover flap 99 may be in the shape of a semi-circle or arc in the apparatus 200 vertical useful arrangement and may be used to cover each of the weep holes 95 individually.

In some embodiments, where the tear drop weep holes 95 are spaced very closely, a single flap 99 may cover the entire set of weep holes 95. In such an embodiment, each of the flap 99 may merge to create an annular ring structure that provides the same function as the individual flaps. The flap 99 location and sizing will be discussed in FIG. 11.

Figure 9:
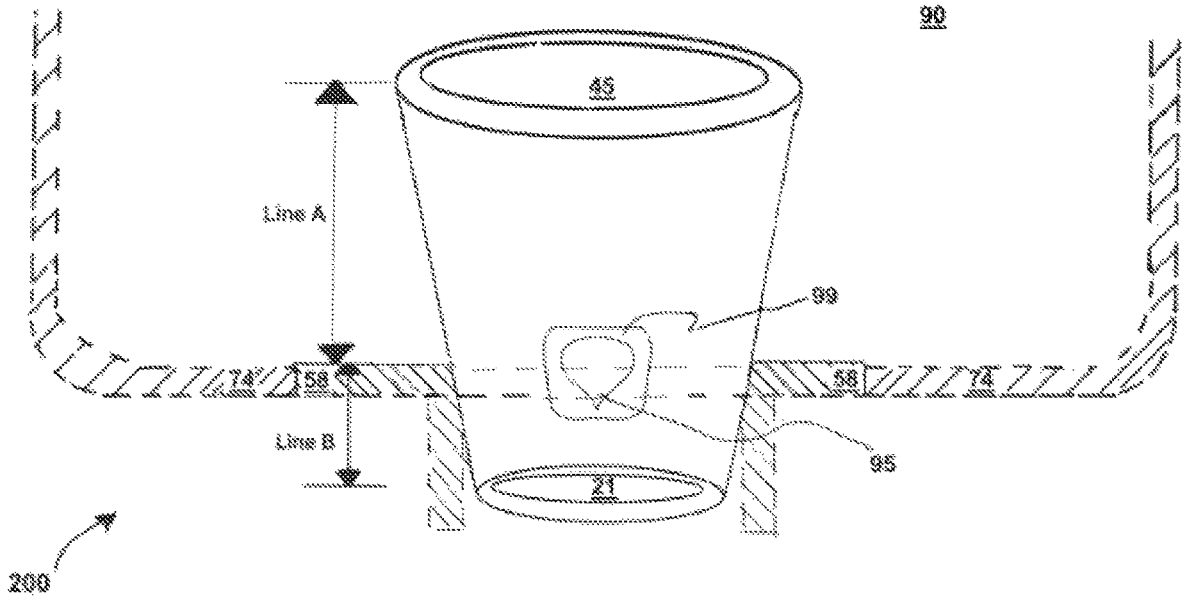
FIG. 9 illustrates the kitchen sink debris corralling and transfer apparatus length ratios in a kitchen sink environment of the present invention.

FIG. 9 illustrates the sink debris corralling and transfer apparatus length ratios. The apparatus 200 useful utility function is determined by the length of said apparatus which allows the said in-sink orifice 45 to be able to capture liquids and solids being mass poured into said orifice. Additionally, the length of the apparatus 200, which translates into height when the apparatus 200 is in the useful vertical position, keeps stacked dish ware away from encumbering the access of the garbage disposal entrance when dishes are stacked high and also keeps glass ware from tipping over into the garbage disposal thereby reducing chances of breakage. Also of note is that the apparatus 200, may be able to be inserted within a kitchen sink flange opening.

FIG. 9 depicts two lines, Line A and Line B. Line A is a line running vertically from the top of the apparatus 200 to the top side of the sink flange 58 horizontal plane. Line B, is a line running vertically from the top of said sink flange 58 horizontal plane to the bottom of the apparatus 200. The Ratio of Line A to Line B is approximately from 3:1.

Figure 10:
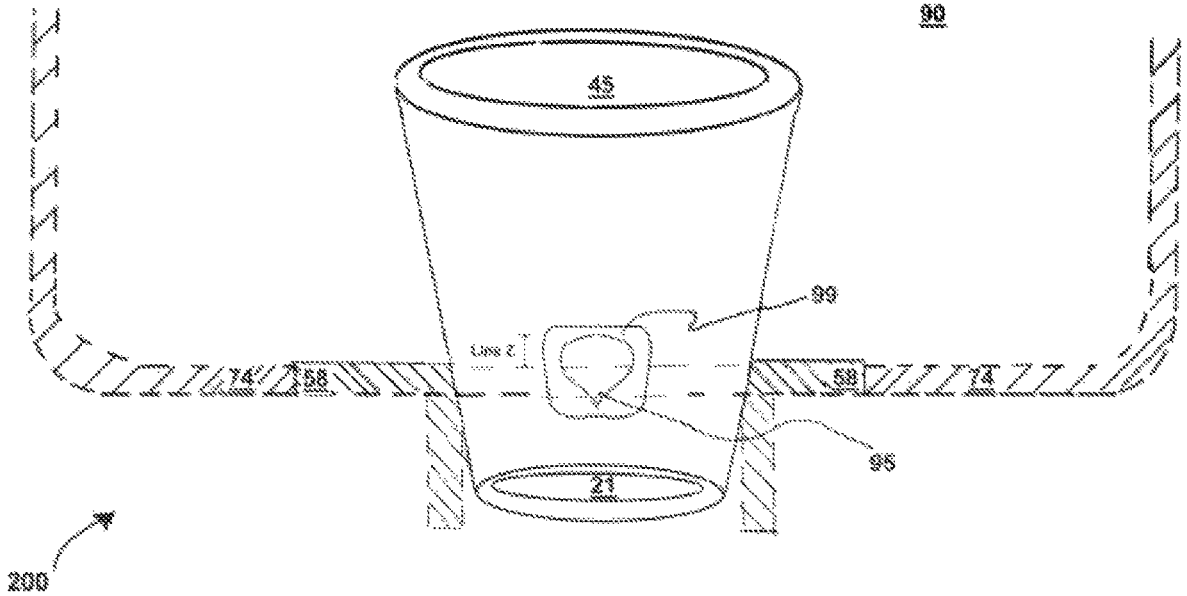
FIG. 10 illustrates the sink debris corralling and transfer apparatus in a useful position and shown of importance at Line Z where the widest width of the tear drop weep hole embodiment is located above the horizontal plane of either the top of a kitchen sink floor or top of a sink flange. This illustration is also an example of where the tear drop weep hole is located in its useful position of the present invention.

FIG. 10 illustrates the sink debris corralling and transfer apparatus 200 in a useful position. Shown of importance is also an example of where the tear drop weep hole 95 is located in its useful position. The placement of such tear drop weep hole 95 is shown by Line Z as having placement where the widest portion of the said weep hole 95 is located above the top of the sink flange 58 horizontal plane and or sink bottom 74 horizontal plane. Also shown is an example of the flap 99 surrounding the tear drop weep hole 95.

Figure 11:
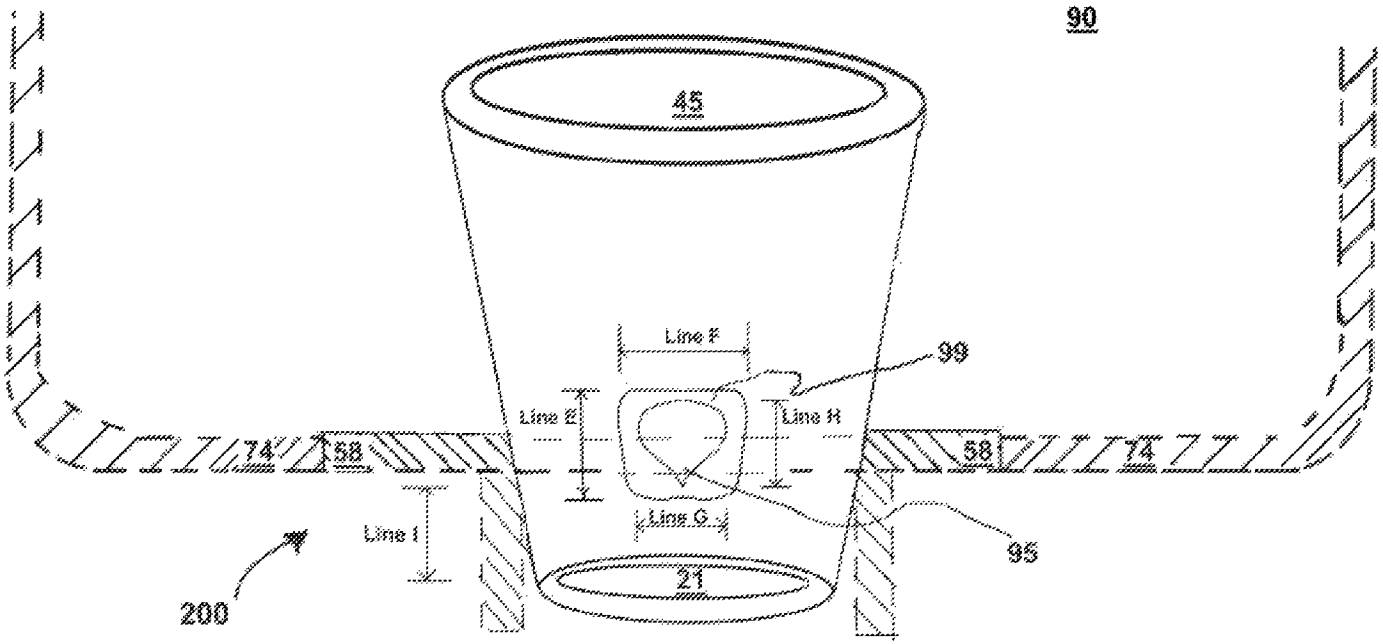
FIG. 11 illustrates the sink debris corralling and transfer apparatus in a useful position and points out specific minimum dimensions for both the tear drop weep holes and the flap embodiment of the present invention.

FIG. 11 illustrates the sink debris corralling and transfer apparatus 200 in a useful position and points out specific minimum dimensions for both the tear drop weep holes 95 and the flap 99 embodiments. The following minimum dimensions are critical for allowance of seeds such as watermelon seeds and larger type of seed and food debris to transfer through the tear drop weep holes. FIG. 11 lays out Lines E, F, G, H and I. Line E describes that the height of the flap covering the tear drop weep hole(s) 95 which may be no less than 0.25 inches. Line F describes that the width of the flap 99 embodiment may be no less than 0.25 inches. Line G describes that the width of the tear drop weep hole 95 may not be less than 0.25 inches. Line H describes that the tear drop weep hole 95 may not be less than 0.50 inch in height. Line I describes that the minimum distance from the distal point end of the tear drop weep hole 95 to the terminal end of the apparatus 200 is no less than ⅝th of an inch. The tear drop weep hole 95 structure allows increased strength at the area to the distal end of the apparatus located in the sink flange in the useful position and thus minimizes the number of tear drop weep holes 95 needed.

The present apparatus may be installed within the in-sink space wherein, the method of installation comprises:

a) holding and installing physically by the user the said inner wall of the said debris corralling and transfer apparatus such that the said in-sink orifice is located vertically above the said sink flange orifice and is inwardly angled for full length when measured downward from the top of the said inner in-sink space orifice;

b) pushing manually by the user, the said debris corralling apparatus, so as to physically unite the said sink floor orifice and the distal portion of the outer wall with the vertical wall of the sink drain flange which covers the sink drain hole; and c) allowing the sink debris liquids to pass through at least one weep hole located in vertical arrangement in proximity to the sink floor orifice and intersecting it, enabling draining of water from the sink floor into the sink drain, wherein the said flap, covering each of the weep hole, prevents splashing back of liquids and solids from the sink, and also splashing back of liquids into the sink.

The above specifications and examples provide a description of the structure and use of exemplary embodiments of the described articles of manufacture and methods. A person of ordinary skill in the art would understand that various changes or modifications may be made thereto without departing from the scope of the claims.

What is claimed is:

1. A kitchen sink debris corralling and transfer apparatus comprising:

an angular, walled structure, having an inner wall and an outer wall, the structure having an inverted conical frustum shape for inserting within a kitchen sink flange opening;

wherein the structure forms:

an in-sink orifice having a top portion having a circumference of a first diameter and a pair of handholds positioned opposite each other proximate to the circumference; and a sink flange orifice of a second diameter, the second diameter smaller than the first diameter of the top portion, the sink flange orifice positioned in the sink flange opening, the interior of the walled structure being open and unobstructed from the in-sink orifice to the said sink flange orifice and located in vertical arrangement in proximity to the sink flange orifice with at least one aperture, the at least one aperture covered by an arched top flap covering, wherein, when inserted into the sink flange opening, the vertical length of a first portion of the apparatus protruding from the top of the kitchen sink floor is greater than the vertical length of a second portion of the apparatus extending below the sink floor.

2. The kitchen sink corralling and transfer apparatus of claim 1, wherein the ratio of the vertical length of the first portion of the apparatus protruding from the top of the kitchen sink floor and the vertical length of the second portion of the apparatus extending below the sink floor is approximately 3:1.

3. The kitchen sink corralling and transfer apparatus of claim 1, wherein the sink flange has a top surface and wherein a first portion of the at least one aperture is positioned above the top of the sink flange and a second portion of the at least one aperture is positioned below the top surface of sink flange.

4. The kitchen sink corralling and transfer apparatus of claim 1, wherein the minimum distance from a distal point of the at least one aperture to a terminal end of the apparatus is approximately ⅝ of an inch.

5. The kitchen sink corralling and transfer apparatus of claim 1, wherein the at least one aperture has a minimum width of approximately 0.25 inches and the minimum height of the at least one aperture is approximately 0.50 inches.

6. The kitchen sink corralling and transfer apparatus of claim 1, wherein the arch flap covering the at least one aperture has a minimum height of approximately 0.25 inches and a minimum width of approximately 0.25 inches.

7. The kitchen sink corralling and transfer apparatus of claim 1, wherein at least one arch flap covers each of the at least one aperture.

8. The kitchen sink corralling and transfer apparatus of claim 1, wherein a single arch flap covers all of the at least one aperture.

9. The kitchen sink corralling and transfer apparatus of claim 1, wherein the arch flap is an extension of an inner wall of the apparatus.

10. The kitchen sink corralling and transfer apparatus of claim 1, wherein each of the pair of hand holds has a minimum height of approximately ⅜ of an inch.

* * * * *